US005771817A

United States Patent [19]

Olausson et al.

[11] Patent Number: 5,771,817

[45] Date of Patent: Jun. 30, 1998

[54] RECOVERY BOILER

[75] Inventors: Lars Olausson, Angered; Jan Bergman, Mölnlycke; Sven-Erik Jansson, Göteborg; Agneta Larsson, Västra Frölunda, all of Sweden

[73] Assignee: Kvaerner Pulping AB, Sweden

[21] Appl. No.: 750,880

[22] PCT Filed: May 18, 1995

[86] PCT No.: PCT/SE95/00562

§ 371 Date: Dec. 17, 1996

§ 102(e) Date: Dec. 17, 1996

[87] PCT Pub. No.: WO95/35409

PCT Pub. Date: Dec. 28, 1995

[30] Foreign Application Priority Data

Jun. 20, 1994 [SE] Sweden ..... 9402152-4

[51] Int. Cl.[6] ..... F23G 7/04

[52] U.S. Cl. ..... 110/238; 110/243; 110/244; 110/245; 110/251

[58] Field of Search ..... 110/238, 251, 110/243, 244, 245

[56] References Cited

U.S. PATENT DOCUMENTS

| | | | |
|---|---|---|---|
| 3,215,099 | 11/1965 | Coulter, Jr. | 110/238 |
| 3,406,642 | 10/1968 | Parkin | 110/238 |
| 3,413,936 | 12/1968 | Matthews | 110/238 |
| 3,421,462 | 1/1969 | Wessberg | 110/238 |
| 4,014,296 | 3/1977 | Astrom . | |
| 4,389,979 | 6/1983 | Saxlund | 110/244 |
| 5,341,753 | 8/1994 | Russell | 110/245 |
| 5,450,803 | 9/1995 | Svensk et al. | 110/238 |
| 5,478,440 | 12/1995 | Paju | 110/238 |

FOREIGN PATENT DOCUMENTS

| | | |
|---|---|---|
| 57-157925 | 3/1981 | Japan . |
| WO93/05228 | 3/1993 | WIPO . |

*Primary Examiner*—Henry A. Bennett
*Assistant Examiner*—Jiping Lu
*Attorney, Agent, or Firm*—Fasth Law Firm; Rolf Fasth

[57] ABSTRACT

A recovery boiler for combusting spent liquor from cellulose cooking while at the same time recovering chemicals. The recovery boiler is constructed for so-called "rotafire" combustion and the speed of rotation of the secondary air has been increased by a constriction of the boiler being arranged at the tertiary air level. The invention also includes a process for using the boiler which is based on certain ports through which the secondary air is blown in being provided with air which is at a higher pressure than that at the other ports on the same level, thereby achieving a higher inflow velocity than from the other ports.

14 Claims, 2 Drawing Sheets

FIG. 2
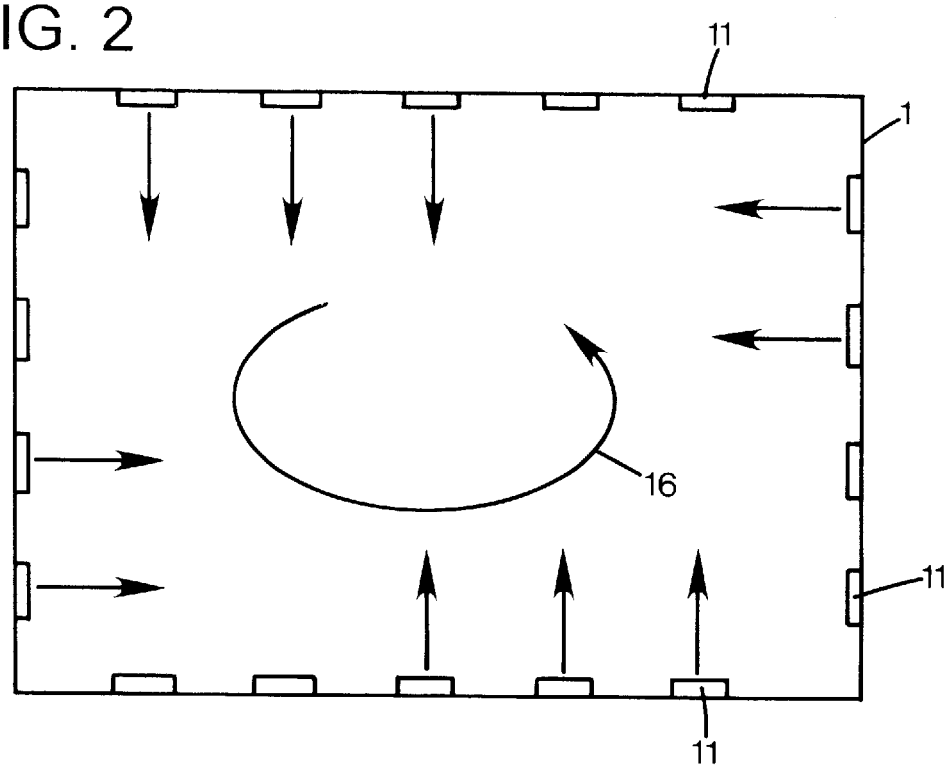
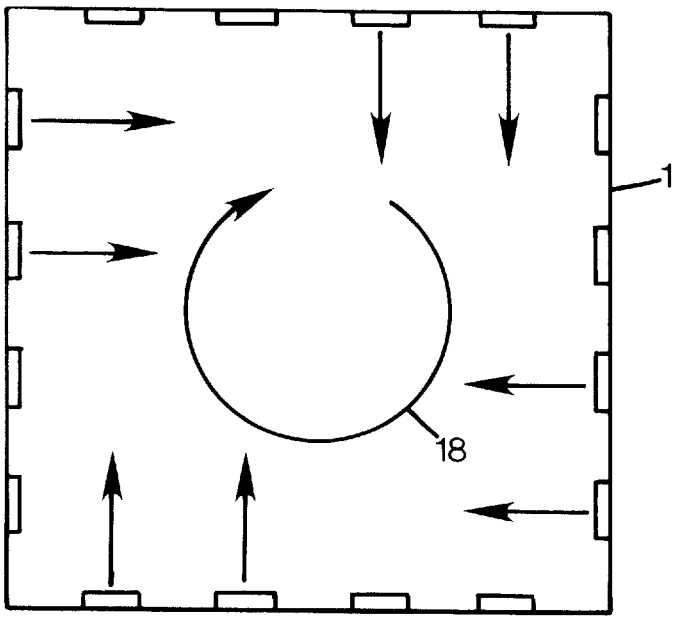
FIG. 3

RECOVERY BOILER

TECHNICAL FIELD

The present invention relates to recovery boilers for combusting spent liquor from cellulose cooking while at the same time recovering chemicals. Apart from water, spent liquor of this nature, which is often termed black liquor, also contains organic residues, principally lignin residues which have arisen during the cooking, and inorganic chemicals, principally sodium sulphate which is used in the cooking. The purpose of the combustion is, in addition to the necessity of disposing of the spent liquor in an environmentally friendly manner, that of extracting heat by means of the combustion, and thus making the whole process more economical, and also that of recovering the inorganic chemicals so that they can be reused, something which additionally reinforces the economy of the process and contributes to a decrease in environmentally inimical discharges.

STATE OF THE ART

Recovery boilers for combusting spent liquors and recovering chemicals during the manufacture of cellulose have been known for decades. While there are a number of different constructions, the general principle is based on the recovery boiler, which consists of an upright cylindrical or polygonal furnace which is clad with water pipes on the inner side, being supplied with spent liquor through nozzles, at a certain level, and with so-called primary air and secondary air, below this level, and with tertiary air, and, where appropriate, quaternary air, at one or more levels above that for the injection of the liquor. In the furnace, in which the temperature is in the region of 1000° C., the water in the liquor drops, which are finely dispersed, is firstly vaporized, after which the organic material is pyrolyzed and converted into combustible gases and carbon, which latter, together with the inorganic chemicals in smelt form, is separated off from the gas by falling down to the buffer bed or else first being slung against the walls and then running down to the bottom, from which the smelt is removed. While there is a reducing atmosphere in the lower part of the furnace, so that sodium sulphate (Na2SO4), for example, is reduced to sodium sulphide (Na2S), the atmosphere in the upper part is oxidizing to ensure that the organic compounds are combusted to completion and that the temperature is increased. While the reducing atmosphere, which is due to an understoichiometric supply of oxygen, is intended to reduce the chemicals, it also acts as a brake on the formation of nitrogen oxides, which are harmful to the environment.

That which determines the speed of drying, pyrolysis and combustion of the coke residue is the transfer of matter or heat between a gas and a solid or liquid particle, in which transfer at least two phases thus participate. More recently, it has been found that, in order to create favourable conditions for the exchange of matter and heat, the shearing velocity and the mixing between gas and particles should be increased, and, as a consequence, the air/gas mixture has been arranged to rotate. This results in a more uniform gas velocity, improved drop separation, a higher combustion temperature, a higher degree of reduction and a lower requirement for air in the lower part of the boiler furnace. The lower requirement for air in the lower part of the furnace of the recovery boiler can be utilized, inter alia, to move a larger part of the combustion higher up the furnace and thereby achieve lower emissions of nitrogen oxides. This rotational procedure, which is termed "rotafire", is described in more detail in European Patent Application No. 92915760.0.

Technical Problem

The principle of a rotating gas mixture in the furnace creates substantially improved conditions for the course of the reaction in the furnace. The advantages achieved are, however, limited in ordinary recovery boilers since there is a limit to the extent to which the speed of rotation can be increased. Thus, if this speed exceeds a certain level, a downwardly directed vortex arises in the centre of the furnace, resulting in an undesirable, non-uniform vertical flow of gases. In addition, the secondary air, which brings about the rotation of the gas mixture and which is supplied through several ports which are located at the same level in the walls, is supplied to the furnace at the same pressure and/or velocity through all the ports. However, it would be possible to achieve more effective firing in accordance with the "rotafire" principle by part of the secondary air being supplied at a greater velocity than can be provided by normal air pressure at this level.

Therefore, there has for a long time been the need to improve "rotafire" firing by increasing the speed of rotation and by regulating this speed to a greater extent.

Solution

Consequently, in accordance with the present invention, a recovery boiler for combusting spent liquor from cellulose cooking while at the same time recovering chemicals has been produced, in which the combustion air is arranged to be blown in as primary and secondary air below the level at which the liquor is injected and as tertiary and quaternary air at various levels above the level at which the liquor is injected, with the secondary air being arranged to be blown in such that a rotation of the air and the gases in the furnace arises around the longitudinal axis of the oven, which recovery boiler is characterized in that the oven has a constriction above the level at which the liquor is injected and in that tertiary air is arranged to be blown in into, or directly above, the constricted part.

In accordance with the invention, it is expedient for the cross-sectional area of the boiler through the constricted part to be less than 90%, preferably less than 70%, of the cross-sectional area of the lower part of the boiler.

In accordance with the invention, the boiler should be a boiler which is polygonal, preferably rectangular, in horizontal section.

In accordance with the invention, the recovery boiler should be constituted such that certain of the blowing-in ports in the secondary air register are arranged to be provided with air which is at a higher pressure than that provided to the remaining ports in the secondary air register.

The ports in the secondary air register which, in accordance with the invention, are to be provided with air at a higher pressure can be connected to a booster fan or to the air supply system for the tertiary and/or quaternary air.

In accordance with the invention, the wall section around the furnace which is located directly above the out-flow openings (run openings) for chemical smelt should be designed to have an inwardly projecting part (nose) which protects the openings from splashes of uncombusted drops, which part penetrates for at least 0.2 m, preferably at least 0.5 m.

The invention also includes a process for combusting spent liquor using the recovery boiler in accordance with the invention, which process is characterized in that the air which is blown in through the special high-pressure ports for the secondary air has a water-column pressure of 100–500 mm and the air which is blown in through the other ports has a water-column pressure of 50–100 mm.

DESCRIPTION OF THE FIGURES

The invention will be described in more detail below with reference to the attached drawings in which FIG. 2 shows, in horizontal section, an arrangement of the ports for blowing in secondary air in accordance with the invention.

FIG. 3 shows, in horizontal section, an arrangement of the ports for blowing in tertiary air in accordance with the invention.

PREFERRED EMBODIMENT

Figure 1:
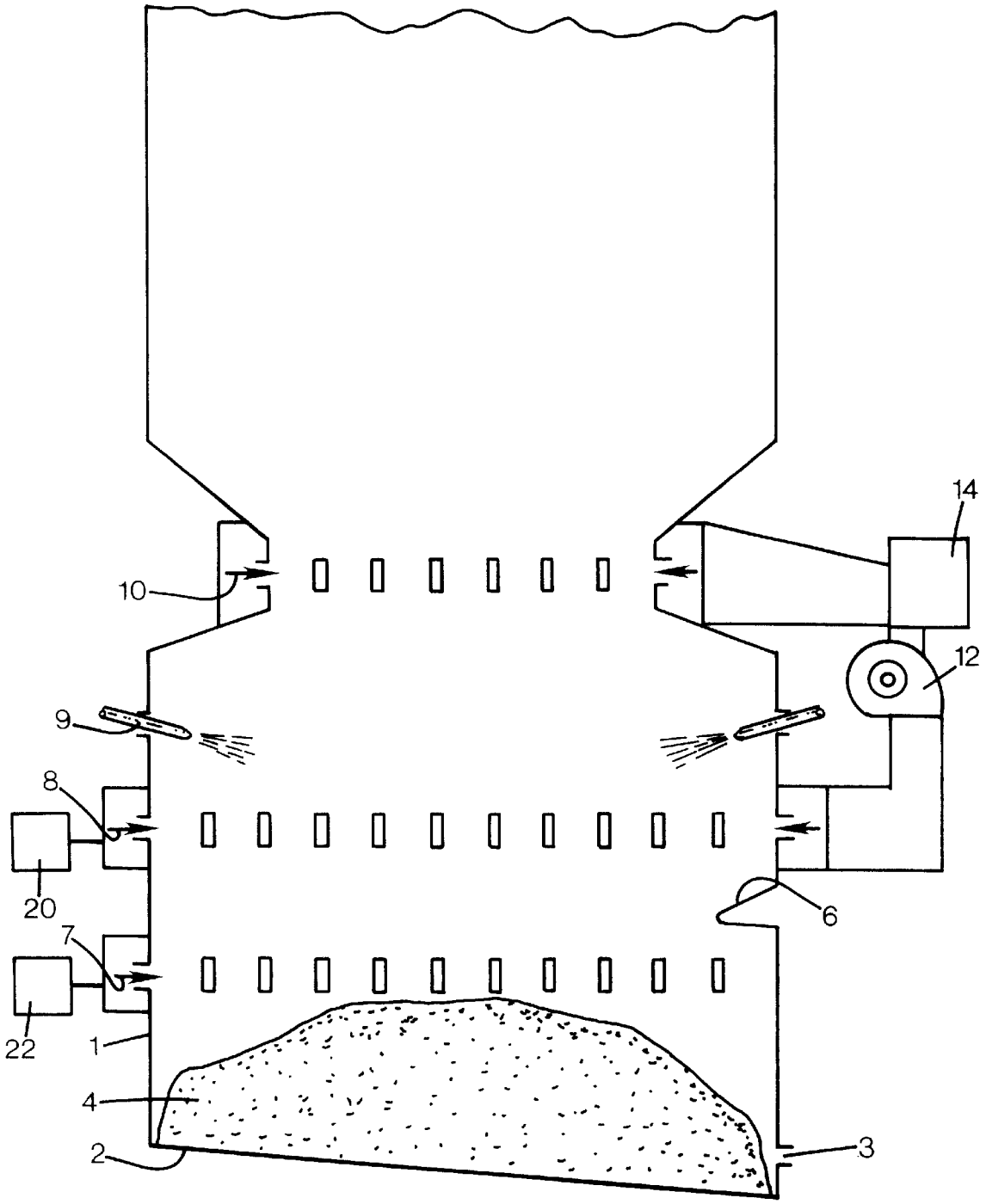
FIG. 1 shows diagrammatically, in vertical section, a recovery boiler according to the invention.

FIG. 1 shows, diagrammatically and in vertical section, the lower part of a recovery boiler. The upper part can be of a conventional type and is not included in the present invention. While the boiler is polygonal, usually rectangular, in horizontal section, in accordance with the invention it can be octagonal or have even more sides so that it approaches a circular shape. The wall sections are plane and are clad internally, in a conventional manner, with pipes through which water flows for extracting heat. The lower part 1 in the figure is delimited below by a bottom 2. So-called run openings 3 are arranged at a certain level above the bottom 2. These run openings are for the outflow of smelt and thus constitute the highest level for this smelt. A coke bed 4 gradually collects on the bottom part 2, which coke bed is also saturated with smelt chemicals which are reduced in it.

Primary air is blown in through a number of ports at level 7, and secondary air is also blown in through a number of ports at level 8. The liquor is injected through a number of nozzles at level 9. The injection of the liquor normally takes place such that the jets of liquid are caused to strike against a plate and, as a result, be broken up into droplets.

A nose 6, which protects the run openings 3 from splashes from the gas/liquid mixture which is whirling around in the oven, has been created between the primary air level 7 and the secondary air level 8. The reason for the desire to protect the run openings from splashes of this nature is that these splashes, in the form of droplets, can contain both carbon, water and non-reduced chemicals. The noses 6 consist, quite simply, of a bulging-out of the pipe system which makes up the wall and extend inwards for at least 0.2 m, preferably 0.5 m, into the oven.

The secondary air, at level 8, is blown into the oven as shown by an arrow 16 in FIG. 2 in such a manner that a rotation arises around the vertical axis of the oven. This is described in European Patent Application No. 92915760.0. The secondary air usually has a static, water-column pressure of 100–250 mm as controlled by a pressure control 20, as shown in FIG. 1, which, as a rule, is somewhat higher than the pressure of the primary air.

As has been mentioned above, there is a given upper limit for the speed of rotation of the gas mixture in the lower part 1 of the boiler. If this limit is exceeded, a downwardly directed vortex core arises, which core interferes with the whole of the flow situation in the oven. However, it is very desirable to increase this rotational speed so that smaller liquor drops can be used without their travelling upwards as a result of the gas streams and so that the yield of matter and heat is increased. The cyclone effect results in even relatively small drops of liquor being separated off since the centrifugal force becomes greater as the rotational speed increases.

In accordance with the invention, it has been possible to most this need by decreasing the cross-section of the boiler at a certain distance above the level 9 at which the liquor is injected and, at the same time, blowing in tertiary air through a number of ports located at, or directly above, the level 10. This constriction at level 10 can be so great that the cross-sectional area at this point is less than 90% of the cross-sectional area further down the boiler. A suitable cross-sectional area at this level is approximately 70% or less of that lower down the boiler. While it is advantageous for the constriction at level 10 to be executed symmetrically in the form of "noses", this is not a prerequisite. The noses can either be built up on each wall section surface or else only on one or some of them.

The tertiary air-which is blown in at level 10 should have a configuration and a direction which counteract the rotation in the lower part of the boiler 1. This is most expediently effected by the tertiary air being given a rotation which is opposite to that in the lower part of the oven 1 as shown by an arrow 18 in FIG 3. As a result of the combination of the counterbalancing effect of the tertiary air and the acceleration of the gas stream which is achieved in the constriction, an upwardly rising, virtually uniform flow is produced above the level of the tertiary air, and no opportunity is given for a vortex core to arise which descends from the upper part to the lower part 1. A more intensive rotation can thus be achieved in the lower part.

The secondary air which is supplied to the boiler at level 8 can be given the rotating direction of flow which is shown in FIG. 2. This air is supplied to the oven via a number of ports 11 which are symmetrically arranged in the walls of the oven, which is rectangular in cross-section, as shown in the figure. The supply of secondary air shown in the exemplary embodiment can take place through five ports 11 from each of the long sides and through four ports 11 from each of the short sides. By means of varying the degree of opening of these ports, for example by means of using dampers in accordance with a particular pattern, the gas can be caused to rotate in a plane which is perpendicular to the longitudinal axis of the oven. In the example shown, this is achieved by closing the dampers of two adjacent ports 11 on each side which are located closest to a corner, which ports 11 are essentially diametrically located in pairs in relation to the vertical longitudinal axis. The rotation can be optimized or finely adjusted by means of individually regulating the flow from each open port 11 using the dampers.

In order to achieve optimum rotation of the secondary air, the air should, in accordance with the invention, be blown in through the ports 11 at different speeds. According to the invention, this can be achieved by coupling a so-called booster fan 12 to the inlet conduit for certain ports so that a higher pressure is obtained in these ports than in the other ports. It is also possible to connect these ports to the air supply conduits of an air supply system 14 for the tertiary air or, where appropriate, the quaternary air, since these air streams are at a higher pressure than is the secondary air. In this way, the only further equipment which is required is an additional fan or a connecting conduit to the conduits for the tertiary air or the quaternary air.

While the water-column pressure in the supply conduits for the ports which are to provide a higher inflow velocity should be 100–500 mm, the water-column pressure in the supply conduits for the other ports for supplying the primary air should be 50–100 mm as controlled by a pressure control 22, as shown in FIG 1.

Use of the recovery boiler and the process for combusting spent liquor with this recovery boiler according to the invention has rendered it possible to improve so-called "rotafire" combustion and to achieve optimum conditions for drying, pyrolysis, coke firing and the separation of smelt in the lower part of the boiler. In the upper part, the combustible gases are combusted to completion in a known manner with the aid of an additional supply of air. The increased speed of rotation in the lower part makes it possible to use smaller liquor drops without any increase in carry-over since the cyclone effect ensures that they are separated off. The quantity of combustion air which is necessary in the lower part can be decreased without any fall in the degree of reduction due to the fact that the temperature is maintained despite there being a lower quantity of combustion air.

As a result of these factors, the furnace can be made to be compact.

The constriction and the subsequent expansion result in the rotation of the gas being dampened and in any concentration or temperature differences which are present being evened out.

The invention is not limited to the embodiment shown and can be varied in different ways within the scope of the patent claims.

What is claimed is:

1. A method for combusting spent liquor from cellulose in a recovery boiler while at the same time recovering chemicals therefrom, the method comprises the steps of:

providing a recovery boiler having a level section having a first opening defined therein, the recovery boiler having a second opening defined therein disposed below the first opening, the recovery boiler having a constricted section having a third opening defined therein that is positioned above the first opening, the recovery boiler having a longitudinal axis and providing the recovery boiler with an inwardly protruding member that is attached to an inner wall of the recovery boiler;

providing gases in the recovery boiler;

blowing in combustion air as primary and secondary air into the second opening so that the secondary air is rotated about the longitudinal axis of the recovery boiler in a first direction within the recovery boiler and the secondary air and the gases are arisen along the longitudinal axis of the recovery boiler;

injecting liquor into the first opening;

while injecting liquor, injecting tertiary air into the third opening at the constricted section and causing the tertiary air to rotate in a second direction, the second direction being opposite the first direction; and while blowing in secondary air into the secondary opening, permitting gases to arise along the longitudinal axis of the recovery boiler through the constricted section.

2. The method according to claim 1 wherein the method further comprises the steps of providing a second set of blowing-in ports defined in the recovery boiler for receiving secondary air, providing a first set of blowing-in ports defined in the recovery boiler for receiving primary air and providing primary air having a first pressure to the first set of blowing-in ports and providing secondary air having a second pressure to the second set of the blowing-in ports so that the first pressure is lower than the second pressure.

3. The method according to claim 2 wherein the method further comprises the step of connecting the second set of the blowing-in ports to a booster fan.

4. The method according to claim 2 wherein the method further comprises the step of connecting the second set of the blowing-in ports to an air supply system containing tertiary or quaternary air.

5. The method according to claim 2 wherein the method further comprises the step of providing secondary air to the second set of blowing-in ports having a water-column pressure of between 100 and 250 millimeter and providing primary air to the first set of blowing-in ports having a water-column pressure of between 50 and 100 millimeter.

6. A recovery boiler for combusting spent liquor from cellulose while at the same time recovering chemicals therefrom, comprising:

gases disposed within the recovery boiler, the recovery boiler having a longitudinal axis;

a lower level section having a second lower opening defined therein for receiving primary combustion air therethrough, the lower level section having a first radius;

a medium level section having a second umber opening defined therein for receiving secondary combustion air therethrough so that the secondary air and the gases are rotated within the medium level section to arise along the longitudinal axis of the recovery boiler;

an upper level section having a first opening defined therein for receiving liquor therethrough;

a constricted section disposed above the upper level section, the constricted section having a third opening defined therein for receiving tertiary air therethrough, the constricted section having a second radius, the second radius being smaller than the first radius, the tertiary air being rotatable in a direction that is opposite to a rotational direction of the secondary air; and an inwardly projecting member attached to an inner wall of the recovery boiler and disposed between the second upper opening and the second lower opening.

7. The recovery boiler according to claim 6 wherein the constricted section has a cross-sectional area that is about 90% of a cross sectional area of the lower level section of the recovery boiler.

8. The recovery boiler according to claim 6 wherein the constricted section has a cross-sectional area that is about 70% of a cross sectional area of the lower level section of the recovery boiler.

9. The recovery boiler according to claim 6 wherein the recovery boiler has a cross-sectional area that is polygonal.

10. The recovery boiler according to claim 6 wherein the recovery boiler has a cross-sectional area that is rectangular.

11. A recovery boiler for combusting spent liquor from cellulose while at the same time recovering chemicals therefrom, comprising:

gases disposed within the recovery boiler, the recovery boiler having a longitudinal axis;

a lower level section having a second lower opening defined therein for receiving primary combustion air therethrough, the lower level section having a first radius;

a medium level section having a second upper opening defined therein for receiving secondary combustion air therethrough so that the secondary air and the gases are rotated within the medium level section to arise along the longitudinal axis of the recovery boiler;

an upper level section having a first opening defined therein for receiving liquor therethrough;

a constricted section disposed above the upper level section, the constricted section having a third opening defined therein for receiving tertiary air therethrough, the constricted section having a second radius, the second radius being smaller than the first radius, the tertiary air being rotatable in a direction that is opposite a rotational direction of the secondary air;

an inwardly projecting member attached to an inner wall of the recovery boiler and disposed between the second upper opening and the second lower opening; and the recovery boiler having an outflow opening defined therein for receiving chemical smelt, the projecting member being disposed above the outflow opening to protect the outflow opening from splashes of uncombusted drops and the projecting member having a length that is at least 0.2 meter.

12. The recovery boiler according to claim 11 wherein the projecting member has a length of at least 0.5 meter.

13. A method for combusting spent liquor from cellulose in a recovery boiler while at the same time recovering chemicals therefrom, the method comprises the steps of:

providing a recovery boiler having a level section having a first opening defined therein, the recovery boiler having a second opening defined therein disposed below the first opening, the recovery boiler having a constricted section having a third opening defined therein that is positioned above the first opening, the recovery boiler having a longitudinal axis and providing the recovery boiler with an inwardly protruding member that is attached to an inner wall of the recovery boiler;

providing gases in the recovery boiler;

providing a first segment of blowing-in ports defined in the recovery boiler for receiving primary air;

providing a second segment of blowing-in ports defined in the recovery boiler for receiving secondary air;

providing primary air having a first water-column pressure of between 50 and 100 millimeters to the first segment of the blowing-in ports and providing secondary air having a second water-column pressure of between 100 and 500 millimeters to the second segment of the blowing-in ports;

providing a booster fan;

blowing in combustion air as primary and secondary air into the second opening so that the secondary air is rotated in a first direction along the longitudinal axis of the recovery boiler and within the recovery boiler and the secondary air and the gases are arisen along the longitudinal axis of the recovery boiler;

connecting the second segment of the blowing-in ports to the booster fan;

injecting liquor into the first opening;

while injecting liquor, injecting tertiary into the third opening at the constricted section and causing the tertiary air to rotate in a second direction, the second direction being opposite the first direction; and while blowing in secondary air, permitting gases to arise along the longitudinal axis of the recovery boiler through the constricted section.

14. A recovery boiler for combusting spent liquor from cellulose while at the same time recovering chemicals therefrom, comprising:

gases disposed within the recovery boiler, the recovery boiler having a longitudinal axis;

a lower level section having a second lower opening defined therein for receiving primary combustion air therethrough, the lower level section having a first radius;

a medium level section having a second upper opening defined therein for receiving secondary combustion air therethrough so that the secondary air and the gases are rotated within the medium level section to arise along the longitudinal axis of the recovery boiler;

an upper level section having a first opening defined therein for receiving liquor therethrough;

a constricted section disposed above the upper level section, the constricted section having a third opening defined therein for receiving tertiary air therethrough, the constricted section having a cross-sectional area that is about 70% of a cross sectional area of the lower level section of the recovery boiler, the cross-sectional area being polygonal, the tertiary air being rotatable in a direction that is opposite a rotational direction of the secondary air;

the recovery boiler having an outflow opening defined therein for receiving chemical smelt; and an inwardly projecting member integral with an inner wall of the recovery boiler so that the projecting member is disposed above the outflow opening to protect the outflow opening from splashes of uncombusted drops, the projecting member having a length that is at least 0.5 meter.

* * * * *